US007226226B2

(12) United States Patent
Troman

(10) Patent No.: US 7,226,226 B2
(45) Date of Patent: Jun. 5, 2007

(54) PRINTING APPARATUS

(75) Inventor: David Anthony Troman, Gotham (GB)

(73) Assignee: Markem Technologies Limited (GB)

( * ) Notice: Subject to any disclaimer, the term of this patent is extended or adjusted under 35 U.S.C. 154(b) by 109 days.

(21) Appl. No.: 10/501,371

(22) PCT Filed: Jan. 14, 2003

(86) PCT No.: PCT/GB03/00123

§ 371 (c)(1),
(2), (4) Date: Oct. 26, 2004

(87) PCT Pub. No.: WO03/059633

PCT Pub. Date: Jul. 24, 2003

(65) Prior Publication Data

US 2005/0031395 A1 Feb. 10, 2005

(30) Foreign Application Priority Data

Jan. 15, 2002 (GB) ..... 0200768.0

(51) Int. Cl.
*B41J 2/325* (2006.01)
*B41J 25/304* (2006.01)
*B41J 25/308* (2006.01)

(52) U.S. Cl. ..... 400/223; 347/217; 400/120.16; 400/55

(58) Field of Classification Search ..... 400/55–59, 400/223, 235, 279; 347/217
See application file for complete search history.

(56) References Cited

U.S. PATENT DOCUMENTS 4,265,551 A 5/1981 Adamek et al.

(Continued)

FOREIGN PATENT DOCUMENTS

EP 121971 10/1984

(Continued)

OTHER PUBLICATIONS

"Thermal Transfer Printer" definition, Answers.com (from Wikipedia), Sep. 27, 2006.*

(Continued)

*Primary Examiner*—Daniel J. Colilla
(74) *Attorney, Agent, or Firm*—Fish & Richardson P.C.

(57) ABSTRACT

A printing apparatus (10) includes a carrier ribbon supply tool (12) and a carrier ribbon take-up spool (16), a print head (22) having a plurality of heating elements which are individually addressable and energizable selectively to remove pixels of marking medium from the carrier ribbon (14) during a printing operation, a first motor (13) which when the printing apparatus (10) is operated in a first configuration, moves the print head (22) during a printing operation relative to a substrate (15) on which an image is to be printed and when the (10) is operated in a second configuration, the first motor (13) moving the carrier ribbon (14) relative to the print head (22) during a printing operation, and there being a second motor (25) which is operative when the printing apparatus (10) is operated in the first and second configurations to advance carrier ribbon (14) from which pixels of marking medium have been removed in a previous printing operation, onto the carrier ribbon take-up spool (16), the printing apparatus (10) being configurable to either of the first and second printing apparatus (10) being configurable to either of the first and second configurations.

14 Claims, 4 Drawing Sheets

U.S. PATENT DOCUMENTS

| | | | | |
|---|---|---|---|---|
| 4,294,553 | A | 10/1981 | Wuthrich | |
| 4,342,520 | A | 8/1982 | Isobe et al. | |
| 4,621,270 | A | 11/1986 | Mizutani et al. | |
| 4,687,359 | A | 8/1987 | Barrus et al. | |
| 4,921,363 | A | 5/1990 | Nishihara et al. | |
| 5,074,685 | A * | 12/1991 | Shimizu et al. | 400/56 |
| 5,182,573 | A * | 1/1993 | Kim | 347/171 |
| 5,445,460 | A * | 8/1995 | Nakajima | 400/120.16 |
| 5,570,959 | A * | 11/1996 | Moriwaki et al. | 400/56 |
| 5,820,277 | A | 10/1998 | Schutte | |
| 5,906,444 | A * | 5/1999 | Jorgensen | 400/229 |
| 5,921,689 | A | 7/1999 | Buckby et al. | |
| 5,975,777 | A | 11/1999 | Nelson et al. | |
| 6,132,115 | A | 10/2000 | Insley et al. | |
| 6,860,659 | B2 * | 3/2005 | Penzo | 400/234 |
| 2004/0141048 | A1 * | 7/2004 | Revelles | 347/217 |

FOREIGN PATENT DOCUMENTS

| | | |
|---|---|---|
| EP | 0 945 273 | 9/1999 |
| GB | 2059356 | 4/1981 |
| GB | 2103546 | 2/1983 |
| GB | 2144082 | 2/1985 |
| GB | 2233284 | 1/1991 |
| GB | 2289652 | 11/1995 |

OTHER PUBLICATIONS

UK Patent Office Search Report dated May 27, 2002.
UK Patent Office Search Report dated Dec. 4, 2002.

* cited by examiner

PRINTING APPARATUS

FIELD OF THE INVENTION

This invention relates to a printing apparatus and more particularly to a printing apparatus of the kind which has a print head with a plurality of heating elements which are individually addressable, e.g. by a computer control, so that the heating elements may selectively be individually energised to cause pixels of marking medium to be removed from a carrier ribbon during printing, the pixels of marking medium being deposited onto a substrate to form a desired image.

More particularly but not exclusively the invention relates to such a printing apparatus which is utilised in a manufacturing and/or packaging environment, e.g. on a packaging line to print onto packaged or part-packaged articles which thus are substrates, or onto labels which are then applied to packaged or part-packaged articles.

BACKGROUND

High performance such printing apparatus are known which are able to print at high speed. Such high performance apparatus utilise high performance print heads, the heating elements of which are able to undergo heating when actuated, and subsequent cooling, more quickly than lower performance print heads which have longer heating/cooling cycle times. However, such high performance apparatus require high performance carrier ribbon to be used, so that the pixels of marking medium can be removed from the ribbon, i.e. "peeled" from the carrier ribbon, at lower temperatures compared to lower performance carrier ribbon.

Where there is an established supply chain, purchasers of such high performance printing apparatus can readily obtain supplies of such high performance carrier ribbon for use in high performance printing apparatus, but where there is an unreliable supply chain, as high performance printing apparatus cannot reliably use lower performance carrier ribbon, where only lower performance carrier ribbon can be obtained, the high performance printing apparatus cannot be used.

This problem is aggravated where printing apparatus of increasingly higher performance are being developed.

In different applications, different types of printing apparatus of the kind with which this invention is concerned, may be used. For example in an application where it is possible for the substrate to be stationary at a print station where the printing apparatus is located, a so called intermittent printer may be used.

In an intermittent printer, the print head is moved at a printing station relative to a stationary substrate and carrier ribbon with selected heating elements being heated in each of a plurality of pixel column positions along the carrier ribbon, to form an image. Typically the print head is moved towards and into contact with the carrier at the beginning of printing to urge the carrier ribbon towards the adjacent substrate, and the print head is moved away from the carrier and substrate at the end of printing. The print head is then returned to a start-of-printing position and the substrate is replaced with fresh substrate which is to be printed upon, and the carrier ribbon may be advanced to bring fresh carrier ribbon into position adjacent the print head for use in subsequent printing.

In an application where the substrate moves past the printing station continuously without stopping, a continuous printer typically is used.

In a continuous printer, the print head is stationary and as the substrate moves past the print head, during printing, carrier ribbon is moved past the print head, usually at about the same speed as the substrate. The heating elements of the print head are sequentially selectively energised so that pixels of marking medium are deposited onto the moving substrate.

Continuous printers are generally designed for the substrate to move past the print head in one direction, i.e. right to left, or left to right to match the direction in which the substrate is moved.

Particularly constructed intermittent printers may be used to print on continuously moving substrate, where the substrate speed is too great for the heating elements of a stationary print head to be heated and cooled fast enough in each column position, to reduce the relative speed between the substrate and the print head.

Thus conventionally for each different application, a printing apparatus of a particular configuration is required. Thus for a printing apparatus manufacturer, it is necessary to produce a wide range of printing apparatus to suit different applications. Where a user changes the configuration of a packaging line, for example where the printing apparatus is for use in a manufacturing and/or packaging environment, an existing printing apparatus may no longer be suitable in the re-configured environment, requiring the purchase of an alternative configuration of printing apparatus.

SUMMARY

Printing apparatus with which the present invention are concerned typically are currently made in countries with a high technology infrastructure. Where they are used in countries without such infrastructure, there are often communication and supply chain difficulties in establishing and supplying the type of printing apparatus which is required for a particular application and appropriate carrier ribbon.

In conventional printing apparatus of the kind with which the present invention is concerned, the carrier ribbon and much of the carrier feed mechanism, is provided on a cassette which has a supply spool from which carrier ribbon is unwound for printing, and a take-up spool onto which the carrier ribbon is wound after use. By providing the carrier ribbon on a cassette, there is no need for a user to thread the carrier ribbon around a ribbon feed path when it is necessary to replenish the carrier ribbon, and in the event of ribbon breakage, simply the cassette may be replaced so as to provide minimal interruption in the printing process. Where the carrier ribbon is broken, the ribbon may be re-threaded so that its cassette may be re-used, whilst printing may continue.

However, where cassettes are particular to particular printing apparatus, again, where there are under-established supply chain infrastructures, the printing apparatus can become unusable because the necessary type of cassette with fresh carrier ribbon, may not readily be avialable.

According to one aspect of the present invention we provide a printing apparatus as set out in claim 1.

Thus the printing apparatus may be configured for either intermittent or continuous printing, with the first motor being alternatively used to move the print head relative to the carrier ribbon, which may be stationary or moving, or to move the carrier ribbon relative to a stationary print head.

Preferably, the first motor moves the print head when operated in the first configuration and the carrier ribbon when operated in the second configuration, via a transmission, the carrier ribbon being disconnected from the transmission in the first configuration and the print head being disconnected from the transmission in the second configuration.

The transmission may include a rotary to linear drive transfer mechanism whereby in the first configuration the print head is carried by a linearly movable part so as to be moved linearly during a printing operation along the carrier ribbon, and in the second configuration the carrier ribbon is entrained around guides on the linearly movable part and around other guides so that as the linearly movable part moves during a printing operation, the carrier ribbon is moved relative to the print head.

Thus in the second configuration, the linearly movable part acts as a shuttle to move a small length of the carrier ribbon required for printing.

When the printing apparatus is operated in the second configuration, and the substrate moves relative to the print head in a first direction, the linearly movable part may be moved in a second linear direction opposite to the first direction to move the carrier ribbon in the same direction as the substrate and vice versa, and where the substrate moves in the first direction, inbetween printing operations, a length of the carrier ribbon may be moved past the print head which is generally equal to the length of carrier ribbon used in the preceding printing operation plus the length of carrier ribbon to be used for the next printing operation.

Thus unlike conventional printers, image printing occurs from unused carrier ribbon towards used carrier ribbon.

When the substrate moves relative to the print head in a second direction opposite to the first direction, inbetween printing operations the carrier ribbon is preferably generally stationary relative to the print head.

In each configuration preferably there is a peeler device associated with the print head which is operable to assist in the removal of pixels of marking medium from the carrier ribbon. When the apparatus is operated in the second configuration and the carrier ribbon and substrate are moved in the first direction relative to the print head during a printing operation, the print head and associated peeler device may be positioned in a first position such that the carrier ribbon is entrained about the peeler device so as to pass over the peeler device during a printing operation subsequent to passing the print head, and when the apparatus is operated in the second configuration and the carrier ribbon and substrate are moved in the second direction relative to the print head during a printing operation the print head and associated peeler device may be positioned in a second position such that the carrier ribbon is entrained about the peeler device so as to pass over the peeler device during a printing operation subsequent to passing the print head.

In a preferred embodiment, the second motor is coupled to the take-up spool via an overdrive clutch and the second motor drives a drive roller around which the carrier ribbon is entrained, whereby the carrier ribbon may be advanced onto the take-up spool when the drive roller is driven. However alternative drive mechanisms for the second motor may alternatively be used.

The supply and take-up spools, and guides which guide the carrier ribbon at least partially around a carrier ribbon feed path may be mounted on a base, and a transmission, which may include a rotary to linear drive transfer mechanism, may also be mounted on the base whereby the apparatus may be re-configurable from the first to the second configuration by disconnecting the transmission from the print head, fixing the print head relative to the base, and entraining carrier ribbon around guides on a linearly movable part of the transfer mechanism and around guides which are mounted on the base.

When the apparatus is operated in at least the first configuration, the print head may be moved towards the adjacent carrier ribbon and substrate during printing to urge the carrier ribbon towards the substrate, and the print head may be moved away from the carrier ribbon and substrate after printing. Although the print head movement towards and away from the carrier ribbon may be achieved by e.g. one or more pneumatic actuators, where there is no available supply of compressed air, the print head may be moved towards and away from the carrier ribbon and substrate at the beginning and end of a priority operation by the first motor, via mechanical guide means including a cam and track, so that the print head is maintained in its position in which it urges the carrier ribbon towards the substrate by the interaction of the cam and track.

According to a second aspect of the invention we provide a printing apparatus as set out in claim 10.

The printing apparatus of the second aspect of the invention may have any of the features of the printing apparatus of the first aspect of the invention.

According to a third aspect of the invention we provide a printing apparatus as set out in claim 12.

The printing apparatus of the third aspect of the invention may have any of the features of the printing apparatus of the first or second aspects of the invention.

According to a fourth aspect of the invention we provide a printing apparatus as set out in claim 14.

The printing apparatus of the fourth aspect of the invention may have any of the features of the printing apparatus of the first, second or third aspects of the invention.

According to a fifth aspect of the invention we provide a method of printing using a printing apparatus as set out in claim 16.

BRIEF DESCRIPTION OF THE DRAWINGS

The invention will now be described with reference to th accompanying drawings in which.

DETAILED DESCRIPTION

Figure 1:
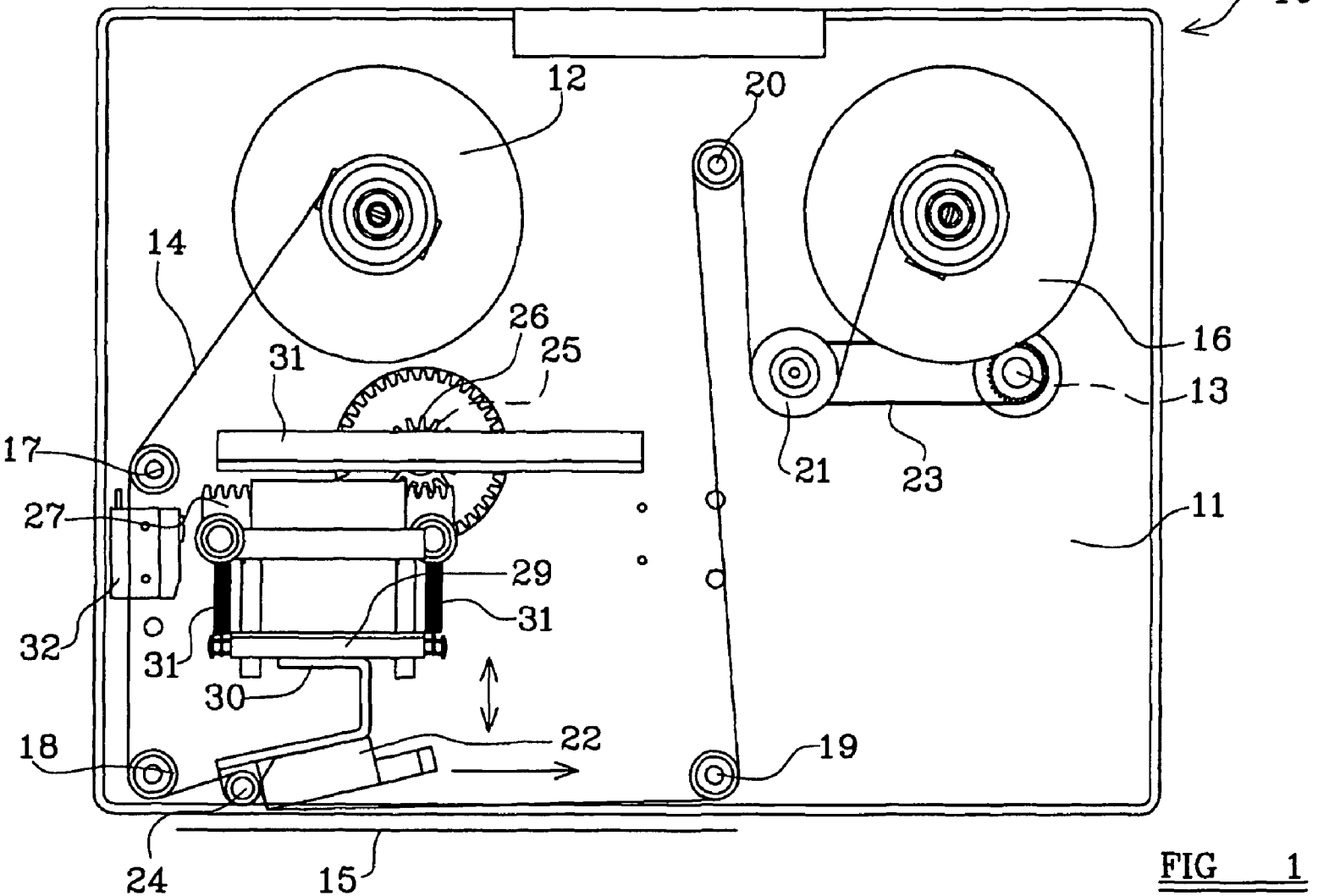
FIG. 1 is a side illustrative view of a printing apparatus in accordance with the invention, in a first configuration.

Referring to FIG. 1 there is shown a printing apparatus 10 in accordance with the present invention, in a first configuration in which the apparatus 10 is to be used for intermittent printing.

The apparatus 10 includes a base 11 which in this example is plate-like, on which base plate 11 are mounted various components of the apparatus 10 including a carrier ribbon supply spool 12 for storing a supply of carrier ribbon 14. The carrier ribbon 14 is of the kind which carries a thermally active marking medium or ink. Upon the ink becoming heated, the ink softens and may be removed from the carrier and deposited onto a substrate such as is positioned as indicated at item 15 in the drawing.

The base plate 11 also provides a mounting for a used carrier take-up spool 16 which is coupled to a drive motor 13 via an overdrive clutch so that the spool 16 may be overdriven to maintain the carrier ribbon taut. The carrier ribbon 14 passes around a ribbon path which in this configuration is provided by a plurality of carrier ribbon guides 17, 18, 19, 20, which in this example are rollers, but could be simple posts, and a drive roller 21, all of which are mounted on the base plate 11. The drive roller 21 is driven by the motor 13 via a drive belt 23 in this example, and the drive roller is a "rogers" roller which is slightly sticky to provide a positive drive to the carrier ribbon 14 when the roller 21 is rotated.

A print head 22 is provided which is of the thermal kind having a plurality of individually computer addressable heating elements in an array, usually a linerar array. When a heating element is selectively addressed, it becomes energised to soften a pixel of marking ink which may then be removed from the carrier ribbon 14 and deposited onto the substrate 15.

In this configuration, the print head 22 is movable relative to the substrate 15 and carrier ribbon 14 which typically would be stationary relative to the base plate 11, the heating elements being selectively energised in a plurality of column positions along the carrier ribbon 14, so that an image may be printed in the substrate 15. However in another example, the substrate 15 and carrier ribbon 14 might be moving relative to the base plate 11 too.

The print head 22 in the example of FIG. 1 moves from left to right during a printing operation and immediately after contact with the heating elements of the print head 22, the carrier ribbon 14 is passed over a peeler device which in this example is a peeler roller 24, to facilitate the removal of the heated and softened pixels from the carrier ribbon 14. At the end of a printing operation, the print head 22 is moved back to the position shown in FIG. 1, and used carrier ribbon is advanced towards the take-up spool 16 by the drive roller 21.

Print head 22 movement is effected by a drive motor 25 through a transmission including a rotary to linear drive mechanism which includes a sprocket 26 which when rotated engages with teeth of a linerarly movable rack 27 to which, in this configuration, is secured a mounting 29 for the print head 22. The print head 22 includes a bracket 30 which is secured to the linear moveable rack 27 which ensures that the print head 22 is at an optimal angle relative to the carrier ribbon 14 and substrate 15 for removing pixels of marking medium.

Linearly moveable rack 27 movement is guided by a track 31 which is preferably mounted on the base plate 11.

Just prior to printing, the print head 22 is moved towards the adjacent carrier ribbon 14 and substrate 15, to urge the carrier ribbon 14 and substrate 15 together, as is desirable for efficient pixel transfer. Just after a printing operation, the print head 22 is moved away from the adjacent carrier ribbon 14, to facilitate moving the print head 22 back to the start-of-print position, and to facilitate advancing the used carrier ribbon 14 towards the take-up spool 16, to enable fresh carrier ribbon 14 from which pixels of ink have not previously been removed, to be positioned adjacent the print head 22 ready for the next printing operation.

This "towards" and "away from" movement of the print head 22 may be achieved using a pneumatic or other fluid powered actuator. However in environments where a ready supply of compressed air or the like is not available, a mechanical arrangement may be used as described below with references to modifications.

An entire printing operation will now be described.

When a substrate 15 is positioned at a printing station adjacent the print head 22 as shown, and with the substrate 15 and carrier ribbon 14 stationary, relative to the base plate 11, the print head 22 is moved towards and into contact with the carrier ribbon 14 and substrate 15. The print head 22 is then moved along the carrier ribbon 14 and substrate 15 whilst the heating elements of the print head 22 are individually selectively energised under computer control, to print an image on the substrate 15. When the print head 22 reaches an end-of print position, a sensor 32 senses arrival of the print head 22, or rather the linearly movable mounting 29. The print head 22 is then moved away from the carrier ribbon 14 and substrate 15 and returned to the start-of-print position while drive roller 21 is actuated to move used carrier ribbon 14 towards the take-up spool 16.

The printing apparatus 10 may be reconfigured, or initially configured in an alternative way, as will be described with reference to FIG. 2. In this configuration, the printing apparatus 10 is configured to be a continuous printer which is arranged to print on moving substrate, as the substrate 15 passes the stationary print head 22.

Figure 2:
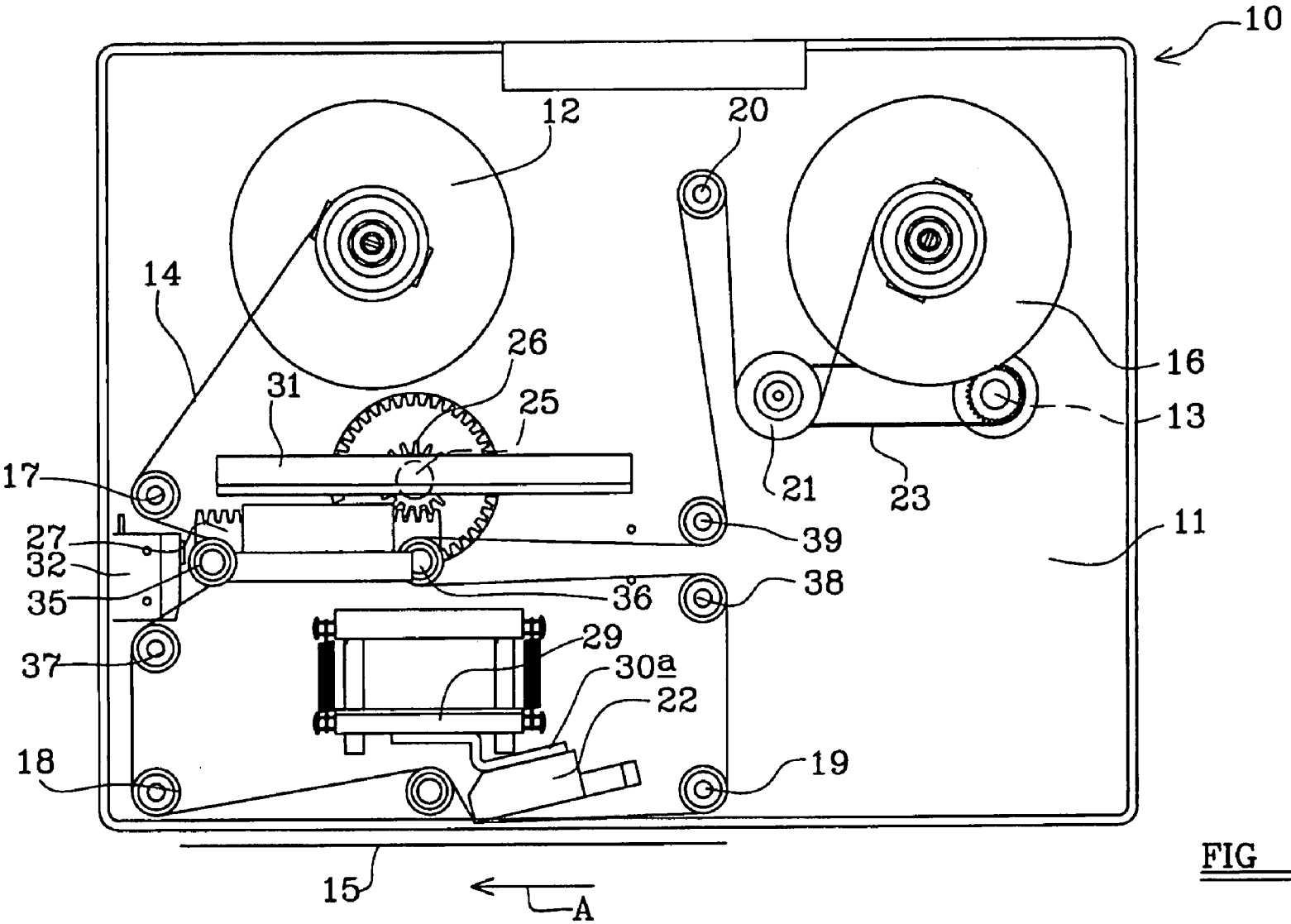
FIG. 2 is a view similar to FIG. 1 of the printing apparatus in a second configuration.

In the FIG. 2 configuration, the substrate 15 is moved through the printing station relative to the print head 22 in a first direction as shown by the directional arrow A. The substrate 15 may be a continuous web, such as for example a backing carrying labels on which images are to be printed, or discrete articles, such as packages carried on a conveyor, for examples only.

In the FIG. 2 configuration, the mounting 29 for the print head 22 has been disconnected from the rack 27, and is fixed relative to the base plate 11 in a desired position for printing. The bracket 30 which in the FIG. 1 example, was provided to attach the print head 22 to its mounting is replaced with an alternative bracket 30*a*, so that the print head 22 is in a correct (first) position for printing in its fixed position.

The carrier ribbon 14 feed path has been changed in as much as the carrier ribbon 14 has been entrained around a pair of guide rollers 35, 36 carried by the rack 27. The carrier ribbon 14 between the two guides 17, 18 is entrained about roller 35 carried by the linearly moveable rack 27, and an additional base plate 11 mounted guide 37, and the carrier ribbon 14 between guides 19 and 20 is entrained around roller 36. Moreover, a further pair of guides 38, 39 between the guides 19, 20 are mounted on the base plate 11, with the linearly movable rack 27 mounted roller 36 between the further pair of guides 38, 39.

During printing, the rack 27 is driven by the sprocket 26 and hence first motor 25 from left to right, in the second direction B as seen in the drawing, i.e. in a direction opposite to the moving substrate 15 on which it is desired to print an image.

By virtue of the carrier ribbon 14 being entrained as described around the various base plate 11 mounted guides 17, 37, 18, 19, 38, 39, 20 and the rack carrier rollers 35, 36, it will be appreciated that as the rack 27 moves from left to right in the second linear direction B, carrier ribbon 14 adjacent the print head 22 will be moved linearly from right to left with the substrate 15, through the printing station, past the print head 22. The linearly movable rack 27 therefore acts as a shuttle to move the carrier ribbon 14 during a printing operation without having to rotate the drive roller 21, thus to achieve differential movement between the print head 22 and carrier ribbon 14 necessary to effect printing of an image on the moving substrate 15.

Preferably the shuttle rack 27 is moved at a linear speed such that the speed of the carrier ribbon 14 past the print head 22 generally matches the speed of the moving substrate 15 so that there is no or little differential movement between the carrier ribbon 14 and the substrate 15 during printing, at least when the shuttle 27 has been accelerated up to the substrate speed.

In this configuration, the sensor 32 which in the FIG. 1 configuration senses the end-of-printing, is repositioned to sense the shuttle rack 27 at the start-of-print position.

At the end of printing it will be appreciated that to the left of the print head 22, there will be a length of carrier ribbon 14 from which pixels of ink were removed during the previous print operation. When the shuttle rack 27 is moved back to its start-of-print position, the used carrier ribbon 14 will be moved back past the print head 22. Hence to ensure that there is fresh carrier ribbon 14 available for the next printing operation, the drive roller 21 is required to be rotated to move a length of fresh carrier ribbon 14 too past the print head 22, at least equal to that which will be used for the next printing operation.

To minimise carrier ribbon 14 wastage if too much fresh ribbon is moved past the print head 22 in the second direction opposite B to the first direction A in which the carrier ribbon 14 moves during printing, whilst ensuring that sufficient fresh carrier ribbon 14 is available so that over printing of already used carrier ribbon 14 does not occur, careful control is required. Particularly where the image length of a subsequent print is not the same as for the previous print, the amount the drive roller 21 is rotated inbetween printing operations may be calculated for each print. By having the sensor 32 in the position described, it can always be assured that whatever length of carrier ribbon 14 was moved past the print head 22 during the previous printing operation, this is moved back past the print head 22 towards the used carrier ribbon 14 take-up spool 16, when the shuttle rack 27 is moved back to its start-of-print position.

With minor adjustments to the configuration of the printing apparatus 10 of FIG. 2, the apparatus 10 may be configured to operate in an alternative mode, namely in which the substrate may move through the printing station relative to the print head 22 in a second direction B, i.e. from left to right. Such mode of operation will now be described with reference to FIG. 3.

Figure 3:
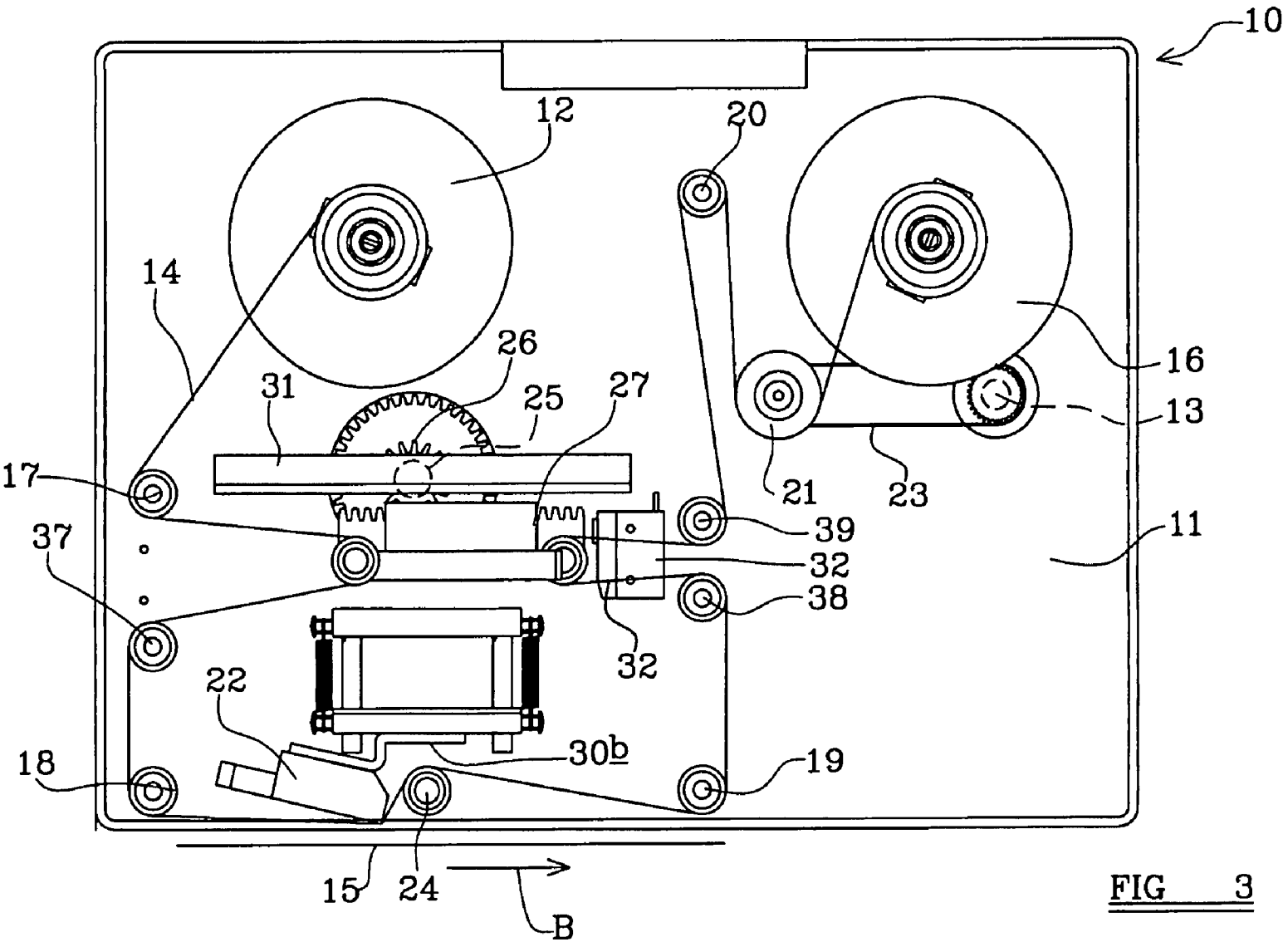
FIG. 3 is a view similar to FIG. 2 with the apparatus in a second configuration, but for operation in an alternative mode.

The only mechanical differences between the printing apparatus 10 shown in FIGS. 2 and 3, are a) that in the FIG. 3 mode of operation, the position of the print head 22 is reversed to a second position correctly to position the array of heating elements of the print head 22 appropriately for printing on the left-to-right moving substrate 15 (this may be achieved by reversing the print head mounting bracket 30*a* as shown at 30*b*), and b) the position of the sensor 32 is returned to the position the sensor 32 occupied in the FIG. 1 configuration.

Of course in the FIG. 3 mode of operation, the shuttle rack 27 is moved from right to left during a printing operation, in the first direction A so that the carrier ribbon 14 adjacent the print head 22 is moved from left to right in the same direction as the substrate 15.

At the end of a printing operation, the shuttle rack 27 is moved back to its start-of-print position, and at the same time the drive roller 21 may be rotated, so that used carrier ribbon 14 in the ribbon path is wound onto the take-up spool 16. Provided that shuttle rack 27 and drive roller 21 movement is coordinated there is no need for any used or fresh carrier ribbon 14 to be fed back past the print head 22 as the shuttle rack 27 returns to its start-of-print position.

It will be appreciated that the same printing apparatus 10 may thus be alternatively configured to provide an intermittent or continuous printer, and that when configured as a continuous printer the apparatus 10 may print images for whichever of the first and second directions the substrate 15 is moving.

By providing a base plate 11 on which the various re-configurable components of the apparatus 10 are mounted, the base plate 11 having all the necessary mountings provided for the components in their different positions, the printing apparatus 10 may readily be reconfigured when necessary. It is envisaged that the apparatus 10 will be supplied from a manufacturer to a customer in one selected configuration, and may be readily reconfigured by the customer as desired.

By providing an apparatus 10 in which the carrier ribbon 14 is provided on a simple spool 12, rather than in a cassette mechanism as is common with conventional printing apparatus 10, even where supply chains are unpredictable, the printing apparatus is less likely to be rendered unusable due to a lack of availability of an appropriate cassette. Also, so that the apparatus 10 may readily be used with different quality carrier ribbons 14, the print head 22 may readily be replaced with an alternative performance print head 22. Thus again, where supply chains are unpredictable, the apparatus 10 is less likely to be rendered unusable through lack of availability of carrier ribbon 14 of a quality to match the performance of the print head 22.

The printing apparatus 10 is used in conjunction with a computer control which controls the operation of the apparatus 10. The computer may be built into a housing of the apparatus 10, or may be separate and connected to the apparatus 10 via a direct or network connection.

Figure 4:
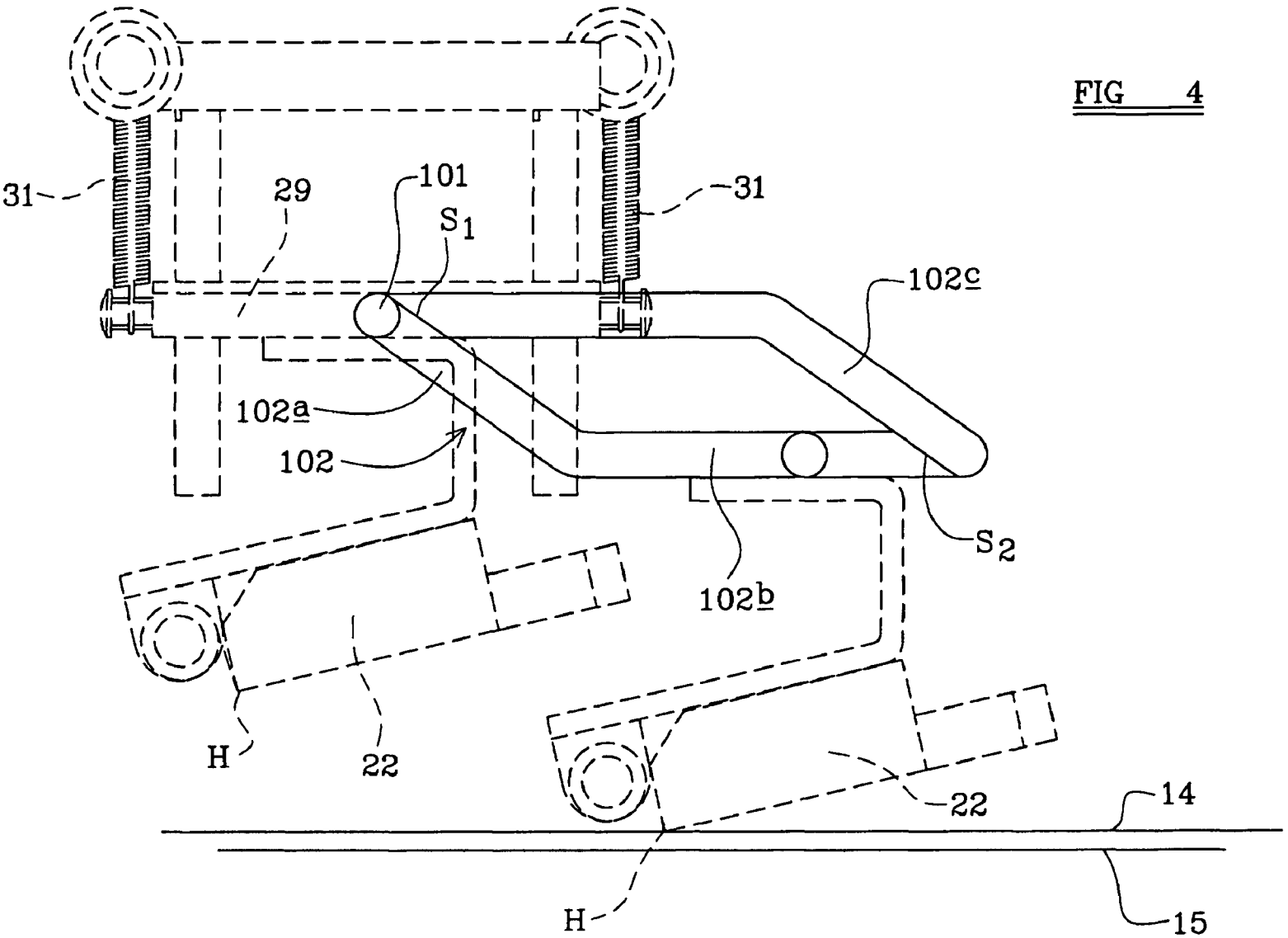
FIG. 4 is an illustration of a cam and track arrangement which may be used in a printing apparatus in accordance with the invention.

It will be appreciated that for different printing modes for which the printing apparatus 10 requires configuring, alternative computer commands would be required for the different printing apparatus 10 configurations. Hence software for driving the printing apparatus may be configurable for different printing apparatus 10 configurations Various modifications may be made without departing from the scope of the invention. For example, an alternative transmission to the sprocket 26 and rack 27 for linearly driving the print head 22 when the apparatus 10 is in the first configuration and for driving the shuttle rack 27 and hence carrier ribbon 14 when the apparatus is in the second configuration may be provided. Any other linearly movable part in place of the rack 27 may be utilised provided that the part can be linearly moved by the motor 25, preferably via a rotary to linear drive mechanism.

Where a supply of compressed air or the like is unavailable for moving the print head 22 towards and away from the carrier ribbon 14 and substrate 15, if desired a mechanical arrangement may be provided to achieve such movement as indicted in FIG. 4. As the print head 22 is initially moved by the motor 25 at the start of a printing operation, via the rack 27, the print head 22, which is carried via the bracket 30 on the mounting 29 which includes a cam 101, is moved towards the carrier ribbon 14 and substrate 15, as the cam 101 is moved in a track 102 provided on the base 11.

During printing, when the heating elements H of the print head 22 are operated to print the image by removing the pixels of marking medium from the carrier ribbon 14, the print head 22 is maintained in its position in which the carrier ribbon 14 is urged towards the substrate 15, by the interaction of the cam 101 and track 102, as the cam 101 moves along the track 102. The track 102 is configured so that as the cam 100 continues to move along the track 102, at the end of printing this causes a movement of the print head 22 away from the carrier ribbon 14 and substrate 15 until just before the linear mounting 29 reaches the sensor 32.

The track 102 is configured so that at the beginning of a print operation, as the mounting 29 commences movement, the cam 101 preferentially moves in a first track part 102*a* which extends towards the carrier ribbon 14 and substrate 15, so that the print head 22 is moved towards the carrier ribbon 14 and substrate 15 as it moves linearly.

Movement of the cam 101 in the first track part 102*a*, rather than along a top track part 102*c* is assured by providing a step S1 in the bottom of the track 102, and by biasing the cam 101 towards the bottom of the track 102 by a spring acting between the mounting 29 and the cam 101.

While the heating elements H are being actuated during image printing, the cam 101 is moved along a second track part 102*b*. The depth of the second track part 102*b* decreases as the cam 101 moves, to a second step S2 where the print head 22 movement stops. Thus, the cam 101 will be biased into and enter a third track part 102*c* at the step S2.

The first motor 13 will then operate in a reverse direction to move the rack 27 in an opposite direction, which in turn will also move the mounting 29 and print head 22 linears back to the FIG. 1 position. Because of the step S2 between the second 102*b* and third 102*c* track parts, the cam 101 is constrained to move along the third track part 102*c* rather than back along the second track part 102*b*.

The third track part 102*c* is configured so that the print head 22 moves away from the carrier 14 and substrate 15 during such reverse movement.

The depth of the third track part 102*c* in the direction along which the cam 101 moves along it, reduces towards the first step 101.

To permit print head 22 movement relative to the mounting 29, springs 31 are provided between the rack 27 and the mounting 29 on which the print head 22 is mounted.

Alternative such mechanical arrangements involving a cam and track are no doubt possible.

Although the base plate 11 construction is preferred, the invention may be realised with the re-configurable components of the printing apparatus 10 being alternatively mounted e.g. on a chassis or other base.

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

The invention claimed is:

1. A printing apparatus including a carrier ribbon supply spool and a carrier ribbon take-up spool, a print head having a plurality of heating elements which are individually addressable and energisable selectively to remove pixels of marking medium from the carrier ribbon during a printing operation, a first motor which when the printing apparatus is operated in a first configuration, moves the print head during a printing operation relative to a substrate on which an image is to be printed, and when the apparatus is operated in a second configuration, the first motor moving the carrier ribbon relative to the print head during a printing operation, and there being a second motor which is operative when the printing apparatus is operated in the first and second configurations to advance carrier ribbon from which pixels of marking medium have been removed in a previous printing operation, onto the carrier ribbon take-up spool, the printing apparatus being configurable to either of the first and second configurations.

2. An apparatus according to claim 1 wherein the first motor moves the print head when operated in the first configuration and the carrier ribbon when operated in the second configuration, via a transmission, the carrier ribbon being disconnected from the transmission in the first configuration and the print head being disconnected from the transmission in the second configuration.

3. An apparatus according to claim 2 wherein the transmission includes a rotary to linear drive transfer mechanism whereby in the first configuration the print head is carried by a linearly movable part so as to be moved linearly during a printing operation along the carrier ribbon, and in the second configuration the carrier ribbon is entrained around guides on the linearly movable part and around immovable guides so that as the linearly movable part moves during a printing operation, the carrier ribbon is moved relative to the print head.

4. An apparatus according to claim 3 wherein when the printing apparatus is operated in the second configuration, and the substrate moves relative to the print head in a first direction, the linearly movable part is moved in a second linear direction opposite to the first direction to move the carrier ribbon in the same direction as the substrate and vice versa, and where the substrate moves in the first direction, inbetween printing operations, a length of the carrier ribbon is moved past the print head which is generally equal to the length of carrier ribbon used in the preceding printing operation plus the length of carrier ribbon to be used for the next printing operation.

5. An apparatus according to claim 4 wherein when the substrate moves relative to the print head in a second direction opposite to the first direction, inbetween printing operations the carrier ribbon is generally stationary relative to the print head.

6. An apparatus according to claim 5 wherein there is a peeler device associated with the print head which is operable to assist in the removal of pixels of marking medium from the carrier ribbon and when the apparatus is operated in the second configuration and the carrier ribbon and substrate are moved in the first direction relative to the print head during a printing operation the print head and associated peeler device are positioned in a first position such that the carrier ribbon is entrained about the peeler device so as to pass over the peeler device during a printing operation subsequent to passing the print head, and when the apparatus is operated in the second configuration and the carrier ribbon and substrate are moved in the second direction relative to the print head during a printing operation the print head and associated peeler device is positioned in a first position such that the carrier ribbon is entrained about the peeler device so as to pass over the peeler device during a printing operation subsequent to passing the print head.

7. An apparatus according to claim 1 wherein the second motor is coupled to the take-up spool via an overdrive clutch and the second motor drives a drive roller around which the carrier ribbon is entrained, whereby the carrier ribbon may be advanced onto the take-up spool when the drive roller is driven.

8. An apparatus according to claim 1 wherein the supply and take-up spools, and guides which guide the carrier ribbon at least partially along a carrier ribbon feed path are mounted on a base, and a transmission which includes a rotary to linear drive transfer mechanism is also mounted on the base whereby in the first configuration the print head is carried by a linearly movable part, the apparatus being re-configurable from the first to the second configuration by disconnecting the transmission from the print head, fixing the print head relative to the base, and entraining carrier ribbon around guides on the linearly movable part and around guides which are immovable relative to the base.

9. A printing apparatus according to claim 1 wherein when the apparatus is operated in at least the first configuration, the print head is moved towards the adjacent carrier ribbon and substrate during printing to urge the carrier ribbon towards the substrate, and the print head is moved away from the carrier ribbon and substrate after printing, and wherein the print head movement towards and away from the carrier ribbon is achieved as the print head is moved by the first motor by mechanical guide means including a cam and track.

10. A printing apparatus including a carrier ribbon supply spool and a carrier ribbon take-up spool, a print head having a plurality of heating elements which are individually addressable and energisable selectively to remove pixels of marking medium from the carrier ribbon during a printing operation, a first motor to move the carrier ribbon relative to the print head during a printing operation, and a second motor to advance carrier ribbon from which pixels of marking medium have been removed in a previous printing operation, onto the carrier ribbon take-up spool, wherein the carrier ribbon is moved past the print head inbetween printing operations to advance used ribbon onto the take-up spool in a direction opposite to the direction the ribbon is moved during a printing operation, and inbetween printing operations, a carrier ribbon length is advanced past the print head generally equal to the length of carrier ribbon used in the preceding printing operation plus the length of carrier ribbon to be used for the next printing operation.

11. A printing apparatus according to claim 10 wherein the printing apparatus is configurable alternatively in first and second configurations and in the first configuration the first motor, during printing, moves the print head relative to a substrate on which an image is to be printed, and in the second configuration the first motor, during printing, moves the carrier ribbon relative to the print head.

12. A printing apparatus including a carrier ribbon supply spool and a carrier ribbon take-up spool, a print head having a plurality of heating elements which are individually addressable and energisable selectively to remove pixels of marking medium from the carrier ribbon during a printing operation, a first motor to move the carrier ribbon relative to the print head during a printing operation, and a second motor to advance carrier ribbon from which pixels of marking medium have been removed in a previous printing operation, onto the carrier ribbon take-up spool, wherein in a first mode of operation when the substrate moves relative to the print head during a printing operation in a first direction, the carrier ribbon moves in the same direction as the substrate, and in a second mode of operation when the substrate moves relative to the print head during a printing operation in a second direction, the carrier ribbon moves in the same direction as the substrate, and in the first mode of operation where the substrate moves in the first direction during a printing operation, inbetween printing operations, a length of the carrier ribbon is advanced past the print head which is generally equal to the length of carrier ribbon used in the preceding printing operation plus the length of carrier ribbon to be used for the next printing operation, and in the second mode of operation when the substrate moves relative to the print head in a second direction during a printing operation, inbetween printing operations the carrier ribbon is generally stationary relative to the print head.

13. A printing apparatus according to claim 12 wherein the printing apparatus is configurable alternatively in first and second configurations and in the first configuration the first motor, during printing, moves the print head relative to a substrate on which an image is to be printed, and in the second configuration the first motor, during printing, moves the carrier ribbon relative to the print head.

14. A method of printing using a printing apparatus including a carrier ribbon supply spool and a carrier ribbon take-up spool, a print head having a plurality of heating elements which are individually addressable and energisable selectively to remove pixels of marking medium from the carrier ribbon during a printing operation the carrier ribbon being movable relative to the print head during a printing operation, and there being a motor to advance carrier ribbon from which pixels of marking medium have been removed in a previous printing operation, onto the carrier ribbon take-up spool wherein the method includes moving the substrate relative to the print head during a printing operation in a first direction, and moving the carrier ribbon in the same direction as the substrate, and moving the carrier ribbon inbetween printing operations in a second opposite direction, the method including, inbetween printing operations, advancing a length of the carrier ribbon past the print head which is generally equal to the length of carrier ribbon used in the preceding printing operation plus the length of carrier ribbon to be used for the next printing operation.

* * * * *